United States Patent [19]

Nagatugi et al.

[11] 4,138,225

[45] * Feb. 6, 1979

[54] MATCH WITH CELLULOSE NITRATE INSTEAD OF SULFUR

[75] Inventors: Shuzo Nagatugi, Kobe; Akira Miyagawa; Suguru Fukuoka, both of Himeji, all of Japan

[73] Assignee: Daicel Ltd., Osaka, Japan

[ * ] Notice: The portion of the term of this patent subsequent to Aug. 9, 1994, has been disclaimed.

[21] Appl. No.: 778,155

[22] Filed: Mar. 16, 1977

Related U.S. Application Data

[63] Continuation-in-part of Ser. No. 654,346, Feb. 2, 1976, Pat. No. 4,040,879.

[51] Int. Cl.[2] ..... C06F 3/00

[52] U.S. Cl. ..... 44/42; 149/18; 149/19.1; 149/19.92

[58] Field of Search ..... 149/18, 19.1, 19.8, 149/19.92, 31, 79, 109.6; 44/42, 47

[56] References Cited

U.S. PATENT DOCUMENTS

| | | | |
|---|---|---|---|
| 2,015,383 | 9/1935 | Konig et al. | 44/42 X |
| 2,062,191 | 11/1936 | Pullen | 44/47 |
| 3,272,604 | 9/1966 | Tigrett et al. | 44/42 |
| 3,650,712 | 3/1972 | Martin et al. | 44/42 |
| 3,775,198 | 11/1973 | Hijikata | 149/18 |
| 4,040,879 | 9/1977 | Nagatugi et al. | 149/19.1 X |

*Primary Examiner*—Edward A. Miller

*Attorney, Agent, or Firm*—Blanchard, Flynn, Thiel, Boutell & Tanis

[57] ABSTRACT

A match head composition is prepared by blending the components of the composition with a binder and water, and wherein the combustion agent of the composition is cellulose nitrate powder wetted with more than 20 weight percent of water and having a particle size of less than 840 microns. The cellulose nitrate is mixed in the composition in an amount of not more than 10 weight percent (water-free basis).

2 Claims, No Drawings

MATCH WITH CELLULOSE NITRATE INSTEAD OF SULFUR

CROSS REFERENCE TO RELATED APPLICATION

This application is a continuation-in-part of Ser. No. 654,346, filed Feb. 2, 1976, now U.S. Pat. No. 4,040,879.

BACKGROUND OF THE INVENTION

1. Field of the Invention

This invention relates to a method of producing a match head composition and the resulting composition.

2. Description of the Prior Art

Generally, matches are produced by preparing a viscous composition by blending an igniting agent or agents such as potassium chlorate, a combustion agent or agents such as sulfur, and other ingredients such as glass powder, diatomaceous earth, boric acid powder, pigment, etc., with a binder and water, attaching this composition to the tips of wood or cardboard sticks and then drying the composition.

However, because sulfur is used as the combustion agent in this composition, the match, when lighted, produces sulfurous acid gas and gives off an offensive smell. Also, when it is desired to make a white-colored match head, the inherent color of sulfur prevents obtaining a vivid color. Therefore, attempts have been made to replace sulfur with other kinds of combustion agents, and some successful results have been reported.

Cellulose nitrate is generally available on the market in the form of a sheet or fibrous mass wetted with an organic solvent such as ethyl alcohol. Some attempts have been made in the past to use this substance in match head compositions, but they were not commercially successful because of the extreme heterogeneity of the composition that resulted from the use of such cellulose nitrate substance and the degeneration of the gelatin, used as a binder, caused by the presence of the organic solvent.

As examples of prior uses of cellulose nitrate in match head compositions, there are mentioned French Pat. No. 699,451 which discloses dissolving cellulose nitrate in an organic solvent and coating that solution on a match head in order to give moisture proof same. U.S. Pat. No. 3,272,604 discloses preparing a re-ignitable match by polymerizing a liquid monomer, such as methyl methacrylate, styrene or vinyl chloride, such liquid monomer having cellulose nitrate and a catalyst dissolved therein and containing other ingredients of the match head composition dispersed therein, whereby to form a solid body.

SUMMARY OF THE INVENTION

As a result of extensive studies, we have discovered that it is possible to omit the sulfur and pine resin previously used as combustion agents and to also reduce the content of potassium chlorate (the igniting agent) by blending in the match head composition finely divided cellulose nitrate powder having a grain size of less than 840 microns (that is, it passes through a 20-mesh (JIS) screen). The cellulose nitrate powder is wetted with water and the water content is more than 20 weight percent, based on the combined weights of cellulose nitrate and water. The amount of cellulose nitrate powder, calculated on a water-free basis, does not exceed 10 weight percent, based on the total weight of the match head composition, calculated on a water-free basis.

We have tested cellulose nitrate powder and discovered that the use of finely divided cellulose nitrate, which has passed through a 20-mesh sieve, that is, it has a particle size of less than 840 microns, can effectively be used to replace sulfur in conventional match head compositions without requiring any other change in the conventional match manufacturing process or conditions.

The finely divided cellulose nitrate powder, as compared with polyethylene and starch which have heretofore been proposed as substitutes for sulfur, has better combustibility at the time of ignition, so that it eliminates the need for using any supplemental combustion agent such as pine resin and it also makes it possible to reduce the amount of potassium chloride used in the composition. Further, the match head manufactured according to the method of the present invention has a higher ignition point than that of the conventional matches whereby to obtain greater safety. Also, since no pine resin is blended therein, the generation of smoke or soot is reduced. Moreover, because cellulose nitrate is useful as an ingredient of paints, it proves helpful in providing a vivid and clear color when colored matches are manufactured.

If the water content in the cellulose nitrate used in the present invention is less than 20 weight percent, based on the combined weights of cellulose nitrate and water, the danger of causing scattering of the cellulose nitrate particles increases. The maximum water content of the cellulose nitrate particles is not critical and can be up to slightly less than 100 weight percent, based on combined weights of cellulose nitrate and water. To minimize the amount of drying and to maintain proper viscosity of the match head composition during match manufacturing, it is preferred that the water content is from 20 to 80 weight percent, especially 30 to 60 weight percent, based on the combined weights of cellulose nitrate and water. If the particle size of the cellulose nitrate powder exceeds 840 microns, interlocking of the particles occurs too much and this impairs its compatibility with the other ingredients of the composition. The cellulose nitrate powder used in the present invention should be as finely divided as possible. The blending weight ratio of cellulose nitrate powder in the composition need not exceed 10 weight percent, based on the total weight of the match head composition. The objects of the invention can be accomplished very well if the cellulose nitrate is used in an amount slightly smaller than the amount of sulfur which is usually blended in conventional match head compositions.

The match head composition according to the invention consists essentially of the following components (all percentages are on a dry weight basis):

1. 40 to 60 weight percent, preferably 45 to 55 weight percent of an igniting component. The igniting component can be any conventional igniting agent for match head compositions, or mixtures thereof. It is preferred that the igniting component is from 50 to 100 weight percent of potassium chlorate and the balance is potassium bichromate, manganese dioxide or mixtures thereof,
2. 0.1 to 10 weight percent, preferably 1.5 to 6.0 weight percent, of cellulose nitrate powder, as described above,
3. 20 to 35 weight percent, preferably 25 to 35 weight percent, of an ignition controlling component. Typical ingredients of the ignition controlling component include glass powder, mica powder, talc, diatomaceous earth, boric acid, colloidal clay and mixtures thereof. Usually glass powder is present in major amounts and it is mixed with minor amounts of one or more of the other ingredients;

4. 10 to 18 weight percent, preferably 10 to 14 weight percent, of binder. The use of glue, gelatin and mixtures thereof is preferred.

The present invention is further described by reference to the following illustrative examples, which are not limiting.

EXAMPLE 1

A match head composition was prepared by blending the following substances at the specified proportions, respectively.

| | | |
|---|---|---|
| Potassium chlorate | 46.1 | weight % |
| Glass powder | 23.5 | " |
| White Carbon | 3.6 | " |
| Diatomaceous earth | 5.9 | " |
| Dextrin | 2.4 | " |
| Boric acid | 0.7 | " |
| Pigment | 1.2 | " |
| Gelatin | 13.0 | " |
| Cellulose nitrate | 3.6 | " |
| (average grain size: 246 microns, moisture; 40 wt.%) | | |

This composition can be ignited just as easily as commercially available matches, it emitted no sulfur smell or other irritating odor and it produced no soot. The surface of the composition had a good gloss and a bright color.

EXAMPLE 2

A match head composition was prepared in the same manner as described in Example 1 by blending the following substances.

| | | |
|---|---|---|
| Potassium chlorate | 54.8 | weight % |
| Glass powder | 15.8 | " |
| Potassium bichromate | 1.4 | " |
| Manganese dioxide | 7.5 | " |
| Starch paste | 2.5 | " |
| Pigment | 0.6 | " |
| Gelatin | 11.6 | " |
| Cellulose nitrate | 5.8 | " |
| (average grain size: 246 microns, moisture: 50 wt.%) | | |

The same results as in Example 1 were obtained.

EXAMPLE 3

A match head composition was prepared in the same manner as in Example 1 by blending the following substances.

| | | |
|---|---|---|
| Potassium chlorate | 47.4 | weight % |
| Glass powder | 21.7 | " |
| Clay | 8.1 | " |
| Perlite | 1.1 | " |
| Zinc flowers | 0.1 | " |
| Pigment | 3.4 | " |
| Gelatin | 13.5 | " |
| Cellulose nitrate | 4.7 | " |
| (average grain size: 246 microns, moisture: 50 wt.%) | | |

The same results as in Example 1 were obtained. Note: Perlite is particles consisting of 70 wt. % of $SiO_2$, 14.3 wt. % of $Al_2O_3$, 0.9 wt. % of $Fe_2O_3$, 0.7 wt. % of CaO, 0.5 wt. % of MgO and 4.6 wt. % of miscellaneous other substances.

The embodiments of the invention in which an exclusive property or privilege is claimed are defined as follows:

1. A match having a friction ignitable tip, said tip consisting essentially of a blend of
   - A. from 40 to 60 weight percent of igniting component, said igniting component consisting essentially of from 50 to 100 weight percent of potassium chlorate and the balance is potassium bichromate, manganese dioxide or mixture thereof,
   - B. from 0.1 to 10 weight percent of cellulose nitrate particles having a particle size of less than 840 microns,
   - C. from 20 to 35 weight percent of an ignition controlling component consisting essentially of a major amount of glass powder mixed with a minor amount of substance selected from the group consisting of mica powder, talc, diatomaceous earth, boric acid, colloidal clay and mixtures thereof, and
   - D. from 10 to 18 weight percent of binder selected from the group consisting of glue, gelatin and mixtures thereof, all percentages being calculated on a dry weight basis, said tip having been prepared by mixing said cellulose nitrate particles wetted with water so as to contain more than 20 weight percent of water, based on the combined weights of said cellulose nitrate particles and water, and being free of organic solvent, with the other ingredients of said tip, and then drying the tip.

2. A match as claimed in claim 1, in which said tip contains from 45 to 55 weight percent of A, from 1.5 to 6.0 weight percent of B, from 25 to 35 weight percent of C and from 10 to 14 percent of D.

* * * * *